United States Patent [19]

Zaltzman

[11] 4,023,245

[45] May 17, 1977

[54] HAND-LOOM CONSTRUCTION

[76] Inventor: Arturo Zaltzman, Calles de Patriotismo 61, Mexico City, Mexico

[22] Filed: July 1, 1975

[21] Appl. No.: 592,321

[30] Foreign Application Priority Data

July 2, 1974 Mexico ..... 152263

[52] U.S. Cl. ..... 28/15

[51] Int. Cl.[2] ..... D03D 29/00

[58] Field of Search ..... 28/15; 139/34

[56] References Cited

UNITED STATES PATENTS

| | | | |
|---|---|---|---|
| 735,177 | 8/1903 | Truesdell | 28/15 |
| 2,292,356 | 8/1942 | Belanger | 28/15 X |
| 2,433,307 | 12/1947 | Thomas | 28/15 |
| 2,573,484 | 10/1951 | Phelps | 28/15 |
| 2,610,436 | 9/1952 | Honeycutt | 28/15 X |
| 3,800,372 | 4/1974 | Daoust | 28/15 |

*Primary Examiner*—Louis K. Rimrodt
*Attorney, Agent, or Firm*—Hopgood, Calimafde, Kalil, Blaustein & Lieberman

[57] ABSTRACT

The invention contemplates a hand-loom construction based upon end-to-end assembly of like pin-frame modules, whereby the connection of adjacent modules establishes an additional pin position, effective to serve the pin-unit spacing of both connected modules. In one form, interengaging formations on connected modules lock to retain the particular angular orientation selected for a particular desired loom geometry.

16 Claims, 10 Drawing Figures

HAND-LOOM CONSTRUCTION

The invention relates to improved hand-loom structure, making possible the manufacture of woven products of a variety of different geometrical patterns and configurations.

The traditional hand loom comprises a single-piece frame with plural yarn-loop pins extending at unit spacing for the periphery of the frame. A single such frame determines the geometry and size of the woven product, and separate additional frames must be constructed, each unique to desired size and geometry, if there is to be a corresponding variety of woven products.

It is an object of the invention to provide a modular hand-loom frame structure lending itself to selective assembly, in multiple end-to-end connection, in a variety of sizes and geometrical shapes, thus enabling a corresponding variety of woven-product shapes and sizes to be produced from the same structural parts.

A specific object is to achieve the above object with a module construction in which the same pin-unit spacing may be served for the pin arrays of adjacent modules, up to and including the situs of interconnection of these modules.

Another specific object is to achieve the above objects with structure which is inherently locked against angular dislocation, once adjacent modules are secured in a desired angular orientation.

A general object is to meet the above object with structure which is of inherently low cost, which is simple to assemble to a desired one of a wide variety of sizes and shapes, and which can be readily modified or reassembled into a different one of such sizes and shapes.

A further object is to provide a knock-down hand-loom kit from which such various sizes and shapes can be selectively assembled.

Other objects and various further features of novelty and invention will be pointed out or will occur to those skilled in the art from a reading of the following specification in conjunction with the accompanying drawings. In said drawings.

Figure 1:
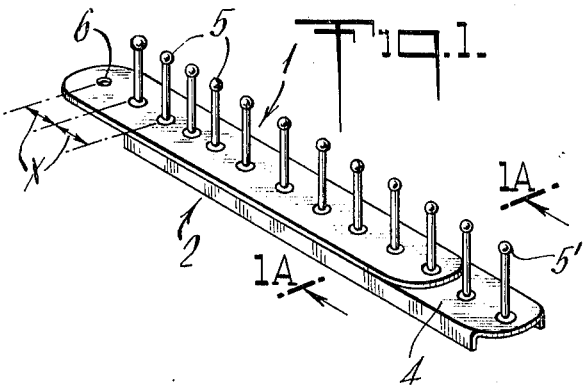
FIG. 1 is a perspective view of a hand-loom frame module of the invention.
Figure 1A:
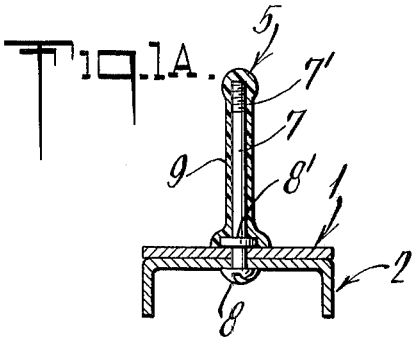
FIG. 1A is a sectional view taken at 1A—1A in FIG. 1.

The frame module of FIGS. 1 and 1A comprises elongate plate and channel elements 1–2 of equal length and assembled in such longitudinal overlap as (*a*) to enable one flat end 3 of plate 1 to project beyond the corresponding end of channel 2 and (*b*) to enable the other end 4 of channel 2 to project beyond the corresponding other end of plate 1. An array of upstanding pins 5 is carried by the assembled parts 1–2, at unit-longitudinal spacings defined by the interval $x$. In the form shown, two such pins rise from the channel end 4, and the array continues to commencement of the projecting plate end 3, where an end aperture 6 exists at the same unit spacing $x$ from the adjacent end pin 5 of the array.

Parts 1–2 may be of metal or plastic. They are preferably secured in their indicated relation, or they may be formed as a single piece, as in the case of an injection-molded plastic article. The pins 5 of the array may be integrally formed with parts 1–2 in the same plastic-molding process, but in the form shown, each pin comprises a head 8 and stem 7 driven into permanently assembled relation, as by stem insertion through openings in parts 1–2 and by force-fit assembly by washer or nut means 8′ against the base of the projecting part of stem 7. A smooth jacket 9 of plastic such as polyethylene completes the pin structure and may be formed by dipping the array, upside down, into a bath of liquid jacket-forming material, and then allowing the same to cure in the shape shown.

Figure 2:
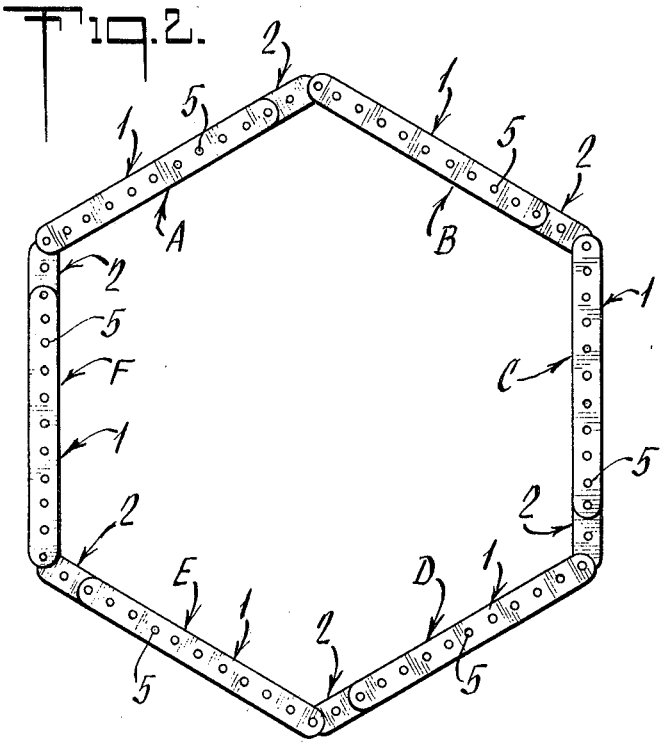
FIG. 2 is a plan view of one geometrical pattern of end-to-end assembly of plural modules of FIG. 1.

At the end pin 5′ of the array, the stem 7 may either be not coated to form jacket 9, or such jacket 9 may be stripped after forming. Thus, pin 5′ may remain sized for insertion through aperture 6 of an adjacent module, in the assembled interconnection of plural modules, as in the case of six such modules A-B-C-D-E-F, to form the hexagonal pattern of the loom of FIG. 2. In the form of FIG. 1A, it will be seen that the outer end of stems 7 are threaded or otherwise ribbed at 7′, for secured retention of a preformed jacket member 9, applied to secure interconnected modules, as will be understood.

Figure 3:
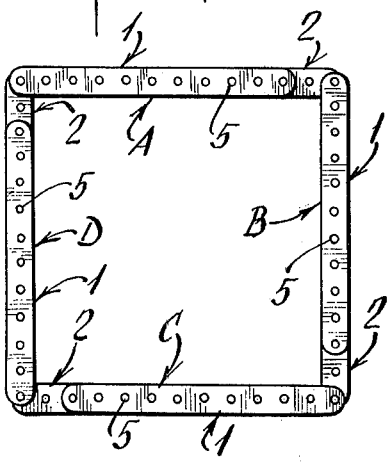
FIG. 3 is a view similar to FIG. 2 to illustrate another geometrical pattern.

In the arrangement of FIG. 3, four of the same modules A-B-C-D are employed in the same end-to-end interconnected relation to define a square loom.

Figure 4:
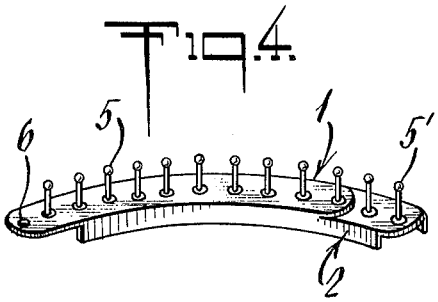
FIG. 4 is a view similar to FIG. 1 to illustrate a modified module.
Figure 5:
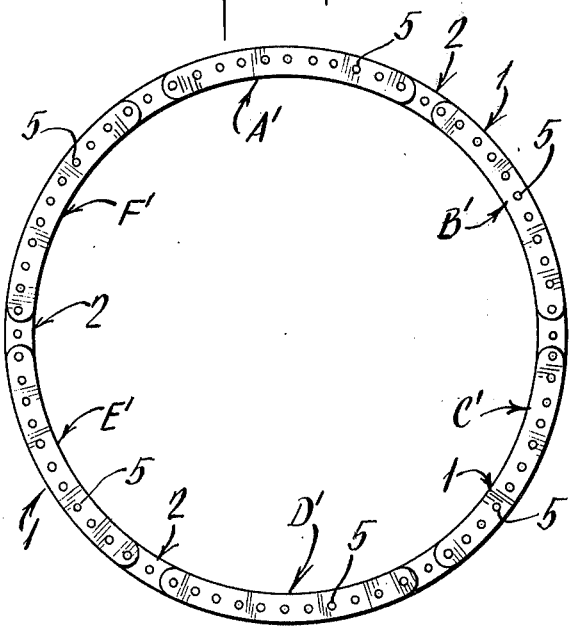
FIG. 5 is a view similar to FIGS. 2 and 3 to illustrate a pattern constructed with modules of the FIG. 4 variety.

FIG. 4 will be recognized from FIG. 1 as an illustration of the same basic structure in a modification wherein the elongation alignment of the module body 10 and its pin array is arcuate. The module nevertheless incorporates the same feature of interlockability with like or similar adjacent modules, as to produce the circular frame of FIG. 1, from secured interconnection of six like 60°-arc modules A′-B′-C′-D′-E′.

Figures 6, 7, 8, 9:
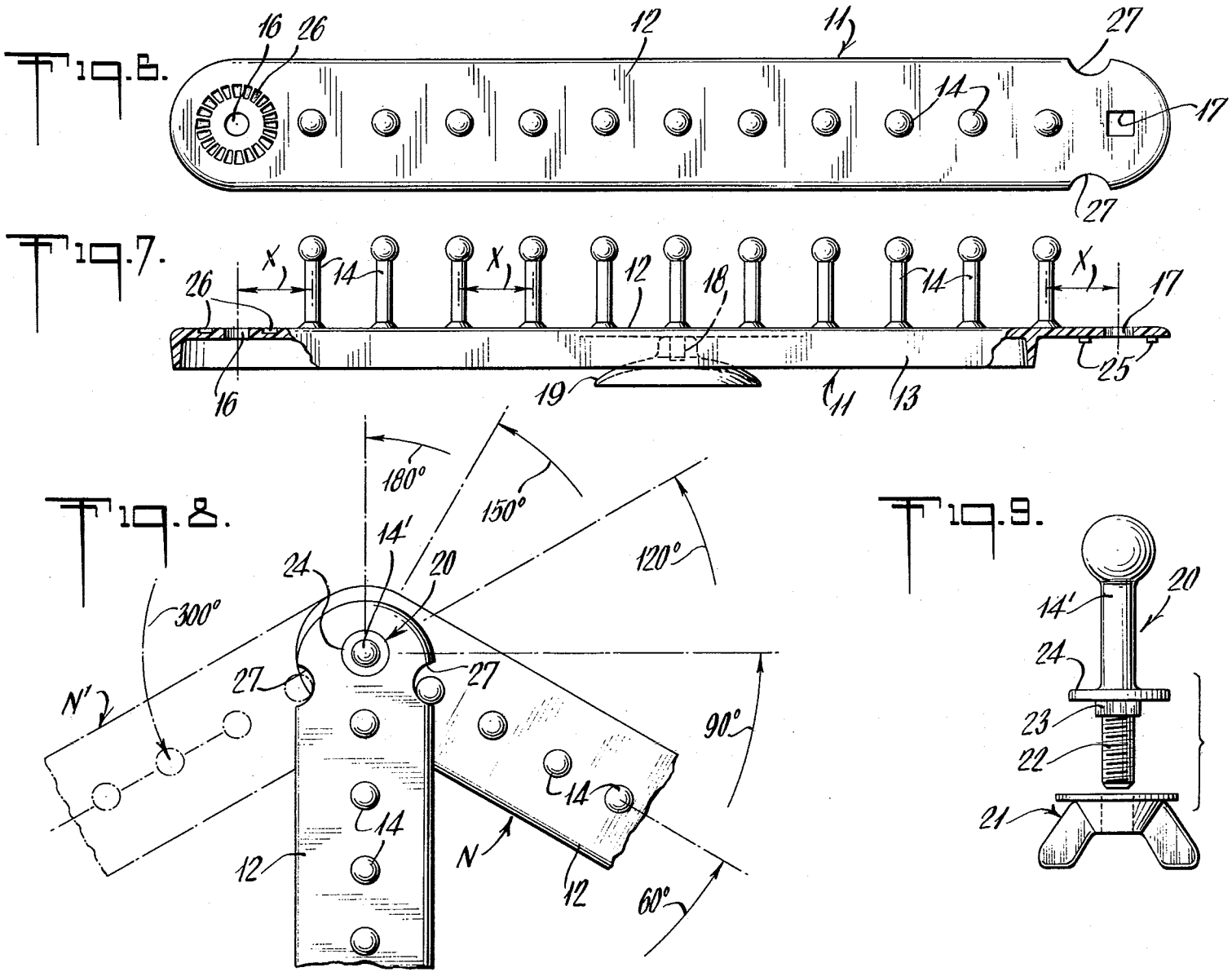
FIGS. 6 and 7 are plan and elevation views of another modified module structure.
FIG. 8 is a fragmentary plan view of connected adjacent modules of FIGS. 6 and 7.
FIG. 9 is an exploded view of fastening means for module assembly as in FIG. 8.

In the modification of FIGS. 6 and 7, a single piece molded-plastic module is seen to comprise an elongate base or body 11, defined by a flat upper panel 12 and by peripherally continuous dependant reinforcement skirt 13. Upstanding pins 14 rise integrally from panel 12, at the same unit spacing $x$, to form an array of preferably eleven such pins. At the skirt-reinforced end 15, a circular aperture 16 is provided in panel 12, on the alignment of the pin array and at the same unit-spacing $x$ from the next adjacent pin 14. At the other end of the module, the panel portion 12′ projects beyond the adjacent longitudinal end of skirt 13, and a keying aperture 17 (for example square-shaped) is provided in portion 12′, at effectively the unit spacing $x$ from the next adjacent pin 14 of the array.

In further description of the module structure, one or more downward stud formations 18 project from integral connection to panel 12 and within the included area of skirt 13, for selective assembly of an elastomeric suction cup 19 thereto. Such suction cups will be understood to simplify module mounting, as to a wall or table surface, to free one's hands for more efficient weaving operations.

Modules of the variety of FIGS. 6 and 7 are assembled to each other by lapping the panel end 12' of one module over the apertured portion of the skirted end 15 of another (adjacent) module, as for the case of modules M and N in FIG. 8, using the fastening-pin device 20–21 of FIG. 9. For such assembly, the apertures 16–17 of the lapped regions are brought into axial registry, and the threaded lower end 22 of element 20 is inserted downwardly therein, with the square portion 23 fitted and keyed to the square aperture 17; at this juncture, the thin base flange 24 of element 20 is seated upon the upper surface of panel member 12', with pin portion 14' thereof projecting upwardly, at the unit-spacing *x* from adjacent pins 14 of module M and of module N. Element 21 is a wing nut, by means of which threads 22 may be engaged to removably clamp the overlapped body regions of modules M–N to secured relation.

In accordance with another feature of the invention, interlocking formations 25–26 are provided at the overlappable surface regions of ends 12'–15, so that when clamped by means 20–21, a selected angular orientation of modules M–N is retained by keyed locking of the overlapped body parts. As shown, the formations 25 comprise a plurality of like, downward key projections on the underside of body region 12', at equal angularly spaced locations about the axis of aperture 17. And the formations 26 comprise a similar plurality of sockets or depressions in the upper surface of panel 12, and equally spaced about the axis of opening 16. Preferably, such projections and sockets are at 30° spacing, i.e., twelve in number, thus enabling secured and locked angular orientations of modules M–N at 30° increments of selection. In FIG. 8, the modules M–N are secured in a 60° angular orientation, as permitted by local arcuate recesses 27 in the end contour of the panel extension 12'. Phantom outlines in FIG. 8 suggest selective availability of eight other orientations, in 30° increments, from the 60° position shown, to and including the 60° reversed orientation suggested at N'.

The described modular structure will be seen to provide selective availability of a wide variety of sizes and shapes, for various looming purposes. The effective connection length between axes of openings 16–17 on each module is conveniently 10 inches (25 centimeters). Three such modules, at the 60° orientation of FIG. 8 will produce a small triangular frame, wherein pins 14 establish twelve equal spacings along each of three 10-inch contour edges; using two modules, interconnected straight (180° orientation), to define each side, one can make a triangular frame of four-times larger area. When modules are fastened at 90° orientation, square and rectangular frames are realized; when securing modules at 120° orientation, hexagonal frames are realized; and when securing modules at 150° orientation, octagonal frames are realized.

In an effective commercial embodiment of the invention, utilizing modules of the FIG. 6–7 variety, I provide eight such modules in a kit, to enable selective assembly of any of the shapes described in the foregoing paragraph. The kit also includes eight of the fastening devices of FIG. 9, and a plurality of suction cups 19, along with a weaving needle and suitable instructions.

The described invention will be seen to have achieved all stated objects. It is found to provide a new dimension to the use of hand looms, and thus gives increased opportunity for exercise of imagination, ingenuity, pleasure and interest on the part of the user.

While the invention has been described in detail for the forms shown, it will be understood that modifications may be made without departure from the claimed scope of the invention.

What is claimed is:

1. A hand-loom kit, comprising a plurality of like structural frame modules, each frame module comprising an elongate body with an array of plural upstanding pins spaced at the same regular longitudinal unit-space interval, said body having a fastening aperture at each end, each fastening aperture being spaced by said unit longitudinal interval from the next adjacent pin, the axis of each fastening aperture being also on an alignment determined by projection of the alignment of the axes of the pins of the array, one of said body ends at the apertured region being adapted to assemble over the apertured region at the other end upon assembly of two frame modules to each other, plural removable fastening means each of which is adapted to extend through axially registering apertures of such overlapped ends, each of such fastening means securing two such frame modules and retaining registry of the apertures while also clamping and retaining a preselected angular orientation of the longitudinal alignments of said frame modules, each such removable fastening means further including upstanding pin structure serving the respective alignments of both secured frame elements, whereby pin structure at each secured interconnection of adjacent modules serves at pin-unit spacing the pin array of both said modules, regardless of the secured angular orientation of said modules.

2. A kit according to claim 1, in which adjacent overlappable surfaces at said body ends include interengageable formations to retain axial alignment of the registering apertures, whereby said pin-unit spacing is retained for said upstanding pin structure with respect to the pins of both modules.

3. A kit according to claim 1, in which adjacent overlappable surfaces at said body ends include plural like interengageable formations at like angular spacings about the respective openings, for angularly locking a selected one of a.plurality of discrete angular orientations of said frame modules when secured by said fastening means.

4. A kit according to claim 3, in which the number of said formations about each opening is 24, whereby a range of selected angular orientations is available at 15° increments.

5. A kit according to claim 1, in which the number of body pins is eleven, whereby for a loop of plural end-to-end interconnected modules, the number of unit pin spacings is twelve for each module.

6. A kit according to claim 1, in which each frame module is a single injection-molded plastic article, integrally formed with said plural pins.

7. A kit according to claim 1, in which the body end which is adapted to overlap the opposite body end of another frame module is relatively thin at the overlappable region.

8. A kit according to claim 7, in which the relatively thin overlappable end is sufficiently extensive to permit lapped-end assembly of adjacent frame modules in at least as small as 60° relative angular orientation.

9. A kit according to claim 8, in which the relatively thin overlappable end is recessed on both lateral sides of the aperture of said relatively thin overlappable end, such recesses being positioned to avoid body-pin interference for the 60° secured orientation.

10. A kit according to claim 1, in which one of the body apertures of each frame module is circular and the other is characterized by a key-locking formation, said fastening means including an anti-rotational formation engaged to said key-locking formation when secured.

11. A unitary structural frame module for end-to-end assembly into a hand-loom structure, said module comprising an elongate body with an array of spaced plural upstanding pins at the same regular unit longitudinal interval, said body extending beyond both longitudinal ends of said array to define body ends each of which has a fastening aperture spaced by said unit interval from the next adjacent pin, the axis of each fastening aperture being also on an alignment determined by projection of the alignment of the axes of the pins of the array, one of the said body ends at the apertured region being adapted to assemble over the apertured region at the other end upon end-to-end assembly of two such frame modules to each other, whereby fastening elements including an upstanding pin at assembly via registering end apertures will serve at pin-unit spacing the pin array of both secured modules, regardless of the secured angular orientation of the secured modules.

12. A unitary structural frame module for end-to-end assembly into a hand-loom structure, said module comprising an elongate body with an array of spaced plural upstanding pins at the same unit longitudinal interval, said body extending beyond both longitudinal ends of said array to define body ends with a connection axis at each end, the connection axes being spaced at said unit interval from the next adjacent pin, the connection axes being also on an alignment determined by projection of the alignment of the axes of the pins of said array, said body having at at least one of said connection axes a fastening aperture, the body end at the apertured region being adapted to assemble with connection-axis registry over the other body of another such module upon end-to-end assembly of two such modules to each other.

13. The module of claim 12, in which said body and array are straight.

14. The module of claim 12, in which said body and array are generally arcuate.

15. A knock-down hand-loom assembly kit, comprising a plurality of like unitary structural frame modules adapted to be assembled in secured end-to-end continuous-loop relation; each module comprising an elongate body with an array of spaced plural upstanding pins at the same regular unit-longitudinal interval, said body extending beyond both longitudinal ends of said array to define body ends each of which has a fastening aperture spaced by said unit interval from the next adjacent pin, the axis of each fastening aperture being also on an alignment determined by projection of the alignment of the axes of the pins of the array; each body end of each module being adapted for assembly in overlap with the adjacent body end of the adjacent module and with the fastening apertures in register, and removable fastening means sized to pass through the registered apertures and including at each reaction of secured overlap an upstanding pin serving the pin-unit spacing of the arrays of both adjacent modules.

16. The assembly of claim 15, in which the adjacent overlapped-end surfaces of all modules include interengaging angle-locking formations retaining the secured angular orientation of adjacent secured modules.

* * * * *